US006261189B1

(12) United States Patent
Saville et al.

(10) Patent No.: US 6,261,189 B1
(45) Date of Patent: Jul. 17, 2001

(54) HUMAN MOVEMENT AND GOLF SWING MONITORING AND TRAINING SYSTEM

(76) Inventors: Phillip Robert Saville, 5251 W. 147th St., Oak Forest, IL (US) 60452; George Kelnhofer, 280 Brietbrumm Chase, Duluth, GA (US) 30155; Delmar Bleckley, 1885 Lake Lucerne Way, Lilburn, GA (US) 30247

( * ) Notice: Subject to any disclaimer, the term of this patent is extended or adjusted under 35 U.S.C. 154(b) by 0 days.

(21) Appl. No.: 08/800,729

(22) Filed: Oct. 14, 1997

(51) Int. Cl.[7] ..... A63B 69/36

(52) U.S. Cl. ..... 473/221; 473/219; 473/151; 473/266; 473/257; 473/261

(58) Field of Search ..... 434/252; 473/219, 473/221, 220, 222, 224, 257, 261, 409, 151, 198, 199, 201, 202, 226, 223, 231, 266, 396, 397, 398, 402

(56) References Cited

U.S. PATENT DOCUMENTS

| | | | | |
|---|---|---|---|---|
| 3,384,741 | | 5/1968 | Bice . | |
| 3,820,781 | | 6/1974 | Kane . | |
| 3,863,933 | | 2/1975 | Tredway . | |
| 3,895,366 | * | 7/1975 | Morris | 340/207 R |
| 4,304,406 | * | 12/1981 | Cromarty | 273/186 R |
| 4,456,257 | | 6/1984 | Perkins . | |
| 4,971,328 | | 11/1990 | Hernberg . | |
| 5,087,047 | * | 2/1992 | McConnell | 273/183 B |
| 5,221,088 | * | 6/1993 | McTeigue et al. | 273/187.2 |
| 5,249,967 | * | 10/1993 | O'Leary et al. | 434/247 |
| 5,269,528 | | 12/1993 | McCardle, Jr. . | |
| 5,277,428 | * | 1/1994 | Goodwin et al. | 273/186.2 |
| 5,672,115 | * | 9/1997 | Sanchez et al. | 473/216 |
| 5,976,022 | * | 11/1999 | Williams | 473/151 |

* cited by examiner

*Primary Examiner*—Valencia Martin-Wallace
*Assistant Examiner*—Julie Kasick
(74) *Attorney, Agent, or Firm*—Kilpatrick Stockton LLP

(57) ABSTRACT

A technique for monitoring a golf swing, human movement in other sports, and other activities involving human movement and for teaching and reinforcing desired human movement. A golf swing is monitored for a golfer swinging a golf club through a tee area while standing on a platform housing a tee manipulation mechanism. Six or more infrared (IR) transmitters transmit respective IR beams along predetermined lines in close proximity to the tee area. Each predetermined line defines a portion of three-dimensional space critical to the optimization of the golf swing. Respective IR sensors receive the respective IR beams. Each pair of IR sensors provides a respective output signal indicative of improper club shaft or body positioning. This device is designed to monitor club shaft and body position and alert the golfer to undesirable positioning via audible buzzer, signal lights, and a golf ball removal system. If the three-dimensional area of optimization is violated, a triggering mechanism within the platform on which the golfer stands removes the golf ball from the path of the clubhead thereby not allowing the golfer to strike the golf ball. With the ability to monitor body positioning and the path of the club shaft and alert the person when inappropriate, ineffective movements are performed, desirable personal movement habits can be immediately reinforced maximizing the training effect.

17 Claims, 4 Drawing Sheets

HUMAN MOVEMENT AND GOLF SWING MONITORING AND TRAINING SYSTEM

REFERENCES CITED

| U.S. PAT. DOCUMENTS | | | |
|---|---|---|---|
| 3,384,741 | 5/1968 | Bice | 273/186.3 |
| 3,820,781 | 6/1974 | Kane | 273/35 R X |
| 3,863,933 | 2/1975 | Tredway | 273/186.3 |
| 4,456,257 | 6/1984 | Perkins | 2731186.3 |
| 4,971,328 | 11/1990 | Hernberg | 273/186.3 |
| 5,269,528 | 12/1993 | McCardle | 273/186.3 |

BACKGROUND OF THE INVENTION

1. Field of Application

This invention relates to systems and methods of monitoring motion applied to human movement, sports and sporting goods generally, and is more specifically directed to a system and method for monitoring the golf club shaft during a golf swing and movement of a portion of a body for teaching golf.

2. Description of the Prior Art

The game of golf is an activity requiring coordinated neuromuscular responses in order to attain proper positioning of the body and its extremities. Integral to a good golf swing is adherence to well-defined clubhead movement and consistency throughout the golf swing.

Prior art equipment for monitoring the golf swing includes many systems which alert the golfer to improper clubhead or body positioning and systems which indicate undesirable technique after the swing is completed. These systems either allow the golfer to strike the golf ball even though improper positioning may have been used or that require the golfer to swing at an imaginary golf ball thereby establishing a learning scenario unlike the actual game for which the training device is designed.

What is needed is a golf swing monitoring system capable of accelerating the learning process by monitoring the entire golf swing and providing instantaneous positive or negative feedback to the golfer for use in improving his or her swing.

SUMMARY OF THE INVENTION

It is therefore an object of this invention to provide a new and improved system for monitoring human movement.

It is another object of this invention to provide a new and improved system for teaching desired human movement.

It is yet another object of this invention to provide a new and improved system for monitoring various golf clubs during their use in golf swings.

It is still another object of this invention to provide a new and improved system for monitoring a golfer during a golf swing.

It is yet still another object of this invention to provide a new and improved method for teaching the golf swing.

It is another object of this invention to provide a new and improved system for indicating undesirable golf club and body position.

It is another object of this invention to provide a new and improved system and method for monitoring golf club positioning and the body movement of portions of the body of a golfer; which system and method does not require the continued presence of an instructor to remind the person to use a desirable golf swing and appropriate body mechanics.

In accordance with these and other objects of the invention, a system is provided for monitoring and displaying golf swing parameters for either a right-handed golfer or a left-handed golfer swinging a golf club through a predefined golf tee area. Briefly, the present invention comprises, but is not limited to, six infrared (IR) transmitters, six IR receivers, controlling electrical switches, six status lights, an audible alarm, and a platform on which the golfer stands during the golf swing and which houses the tee manipulation mechanism. The six pairs of IR transmitters and receivers are used to produce IR beams of light at predetermined locations to define a preferred region in three-dimensional space in which the golf club and the golfer's body should remain at all times during the golf swing. Two converging IR beams are used to monitor golf club shaft position, first during the takeaway phase of the golf swing, and second during the downswing phase of the golf swing. These IR beams determine the boundaries of a channel of preferred space in which the golf club must remain in order to perform a good takeaway and a good downswing during the golf swing. Another IR beam monitors club position at the top of the golf swing. Yet another IR beam monitors club position during the early portion of the downswing phase of the golf swing. Still another IR beam is created by an IR transmitter placed at a height approximating the height of the hips of the golfer and is aimed at an IR receiver placed on the ground in front of the golfer. This beam monitors any tendency during the golf swing of the golfer to lean in the opposite direction of intended ball flight. The remaining IR beam is positioned at the height of the golfer's shoulders and is aimed at an IR receiver placed on the ground in front of the golfer. This beam monitors any tendency of the golfer to lean in the direction of intended ball flight during the golf swing.

If, during the golf swing, movement of the golf club shaft or of the body of the golfer is detected outside of the preferred space defined and monitored by the six IR beams, the corresponding IR beam is interrupted and the violation is detected simultaneously activating three methods of informing and teaching the golfer. An audible tone is immediately activated along with one of six sensor lights which correspond to each of the six IR beams. A latch relay causes any activated lights to remain illuminated until they are reset by the user. Simultaneously an electric servo and tee manipulation device housed within the platform on which the golfer stands causes the tee to move rapidly thereby removing the ball from the path of the swinging club resulting in the absence of a golf ball as the golfer swings through the position of the tee. Resetting the system turns off any illuminated status lights and raises the tee with the golf ball still appropriately positioned on top of the tee.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENT

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover any and all alternatives, modifications and equivalents, which may be included within the spirit and scope of invention as defined by the appended claims.

Figure 1:
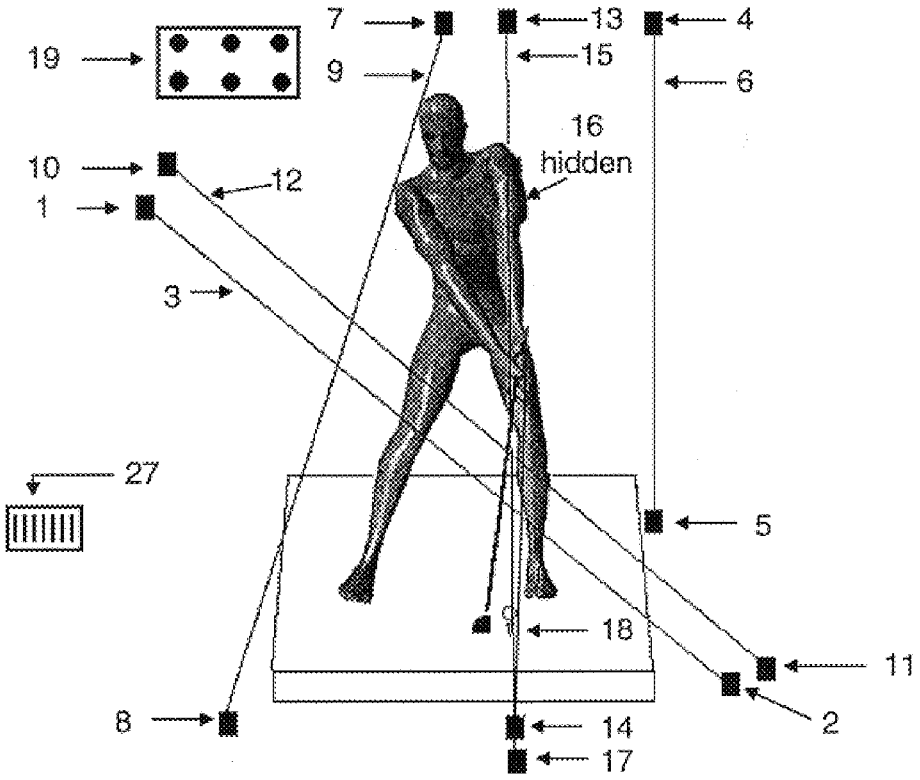
FIG. 1 shows a frontal view of a golfer using the golf training device. Positioning of IR beams is indicated.
Figure 2:
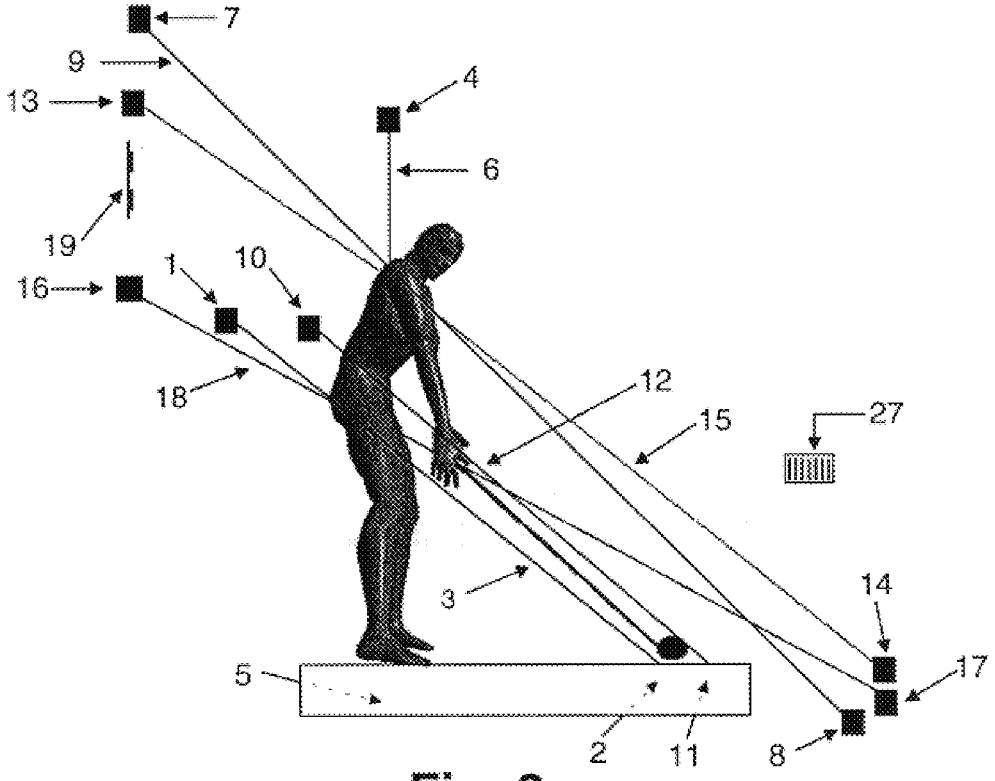
FIG. 2 is a lateral view of the golf training device of FIG. 1. Positioning of IR beams is indicated.
Figure 3:
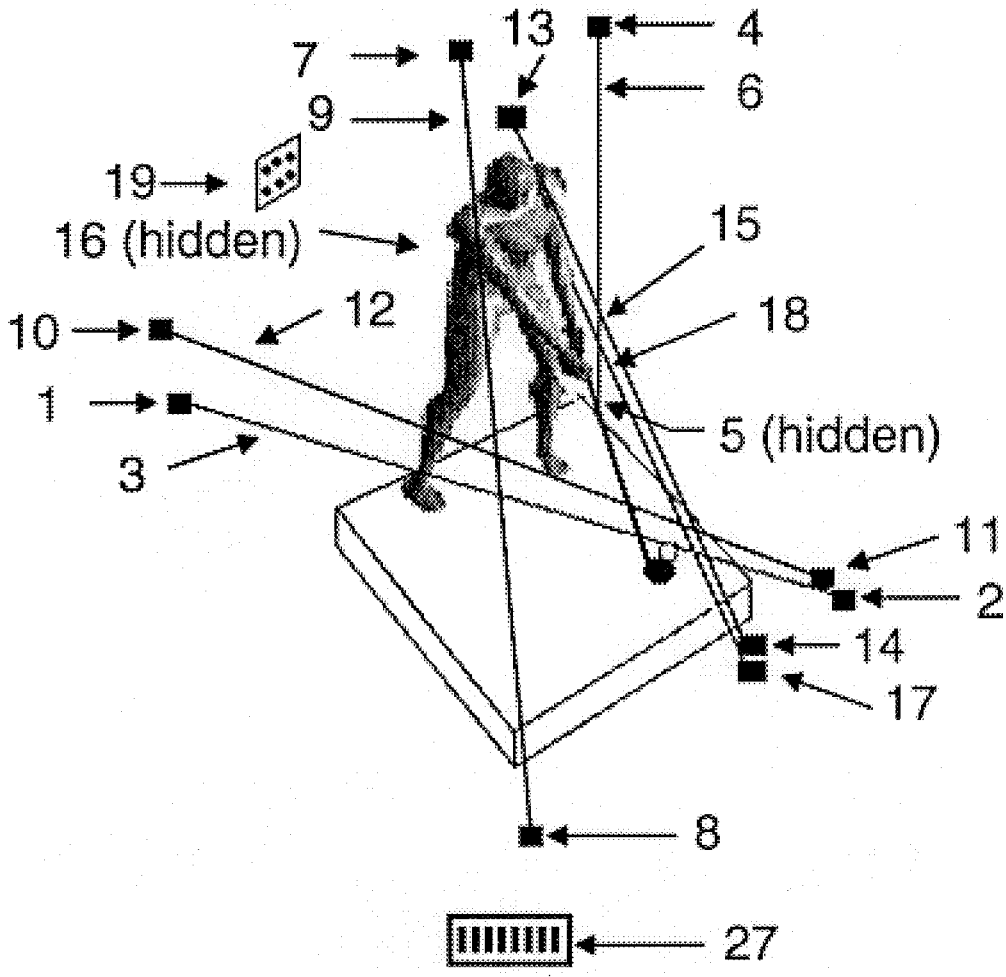
FIG. 3 is an oblique top view of the golf training device of FIG. 1. Positioning of IR beams is indicated.

FIGS. 1, 2, and 3 show respective frontal, side, and oblique top views of a golfer using the golf training device. The control panel 27 is used to arm or not arm any of the teaching methods provided by the golf training device. To arm a teaching method is to set its control switch to the position which enables the teaching method to monitor the golf swing and activate the teaching method, such as audible alarm, status light, infrared (IR) beam, or tee manipulation device, upon violation of the preferred space. In its current embodiment, this invention comprises six control switches, six status lights, six infrared (IR) beams, an audible alarm, and a tee manipulation device. The invention is intended to allow for any number of control switches, status lights, and IR beams. In its current embodiment, any combination of IR beams 3, 6, 9, 12, 15, and 18 can be armed or not armed. The tee manipulation device FIGS. 4, 5A, and 5B can be armed or not armed. The status light board 19 can be positioned behind the golfer in view of a videocamera, the use of which is optional. The status light board 19 is activated or deactivated at the discretion of the user. Positioning the status light board 19 behind the golfer and in view of the optional videocamera is recommended, but not to be considered limiting, in order to eliminate the possibility of distracting the golfer in the event a status light is illuminated and enable the videocamera to record the exact position of the golfer's body and golf club as the preferred space violation occurs and the status light corresponding to the IR beam interrupted is illuminated. Accuracy of event recording is dependent upon the frame capture rate of the video recording device in use.

Figure 4:
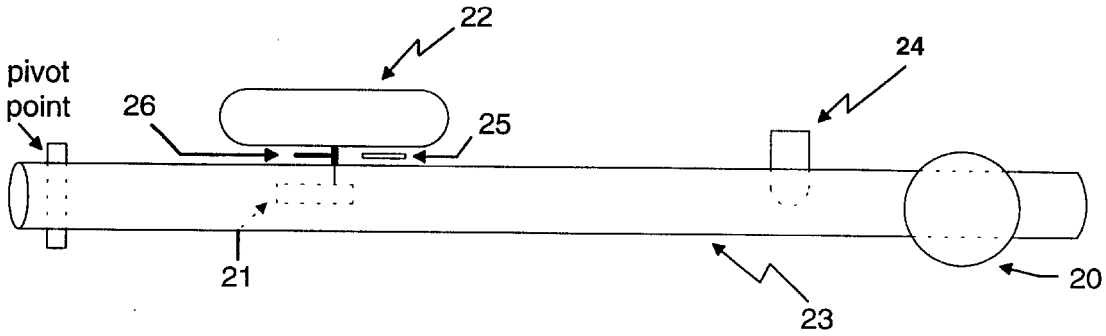
FIG. 4 is a top view of an electric servo and cam mechanism used to manipulate the tee.
Figure 5A:
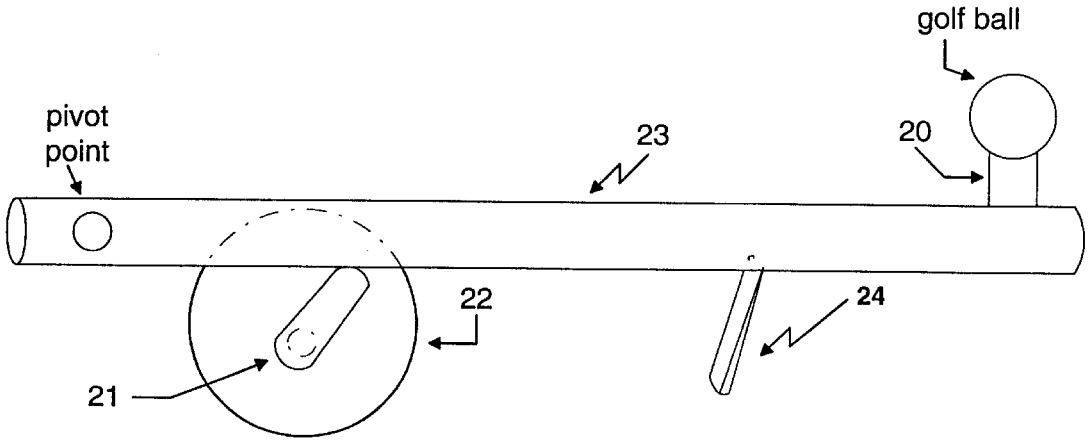
FIG. 5A is a side view of an electric servo and cam mechanism, in the up position, used to manipulate the tee.
Figure 5B:
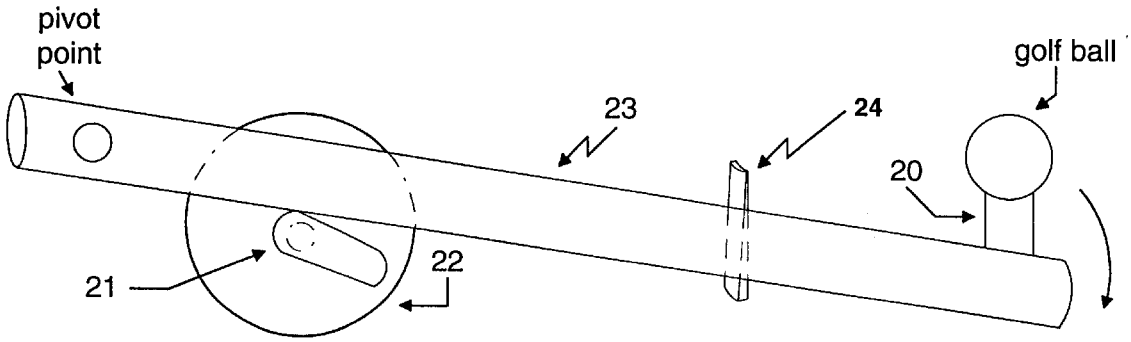
FIG. 5B is a side view of an electric servo and cam mechanism, in the down position, used to manipulate the tee.
Figure 6:
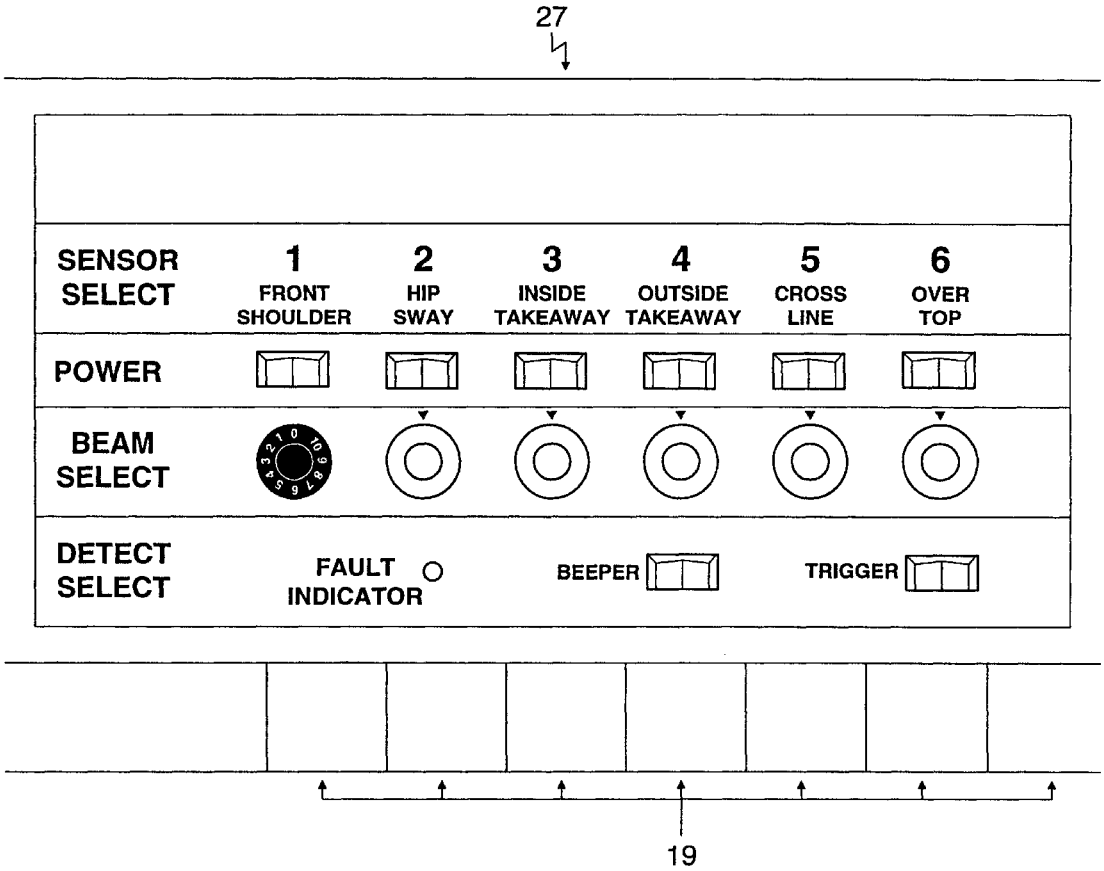
FIG. 6 is a front view of the panel used to control the golf training device of FIG. 1.

FIG. 1 also indicates the position of the movable IR beams relative to the golfer. One IR transmitter 1 is positioned slightly behind the golfer and laterally on the side opposite the direction of intended ball flight. The corresponding IR receiver 2 is positioned frontally to the golfer and is used in conjunction with IR transmitter 1 to produce IR beam 3. IR beam 3 monitors golf club shaft position during the takeaway phase of the golf swing. If, during the takeaway phase of the golf swing, the golfer positions the golf club shaft more posteriorly than is desirable for a good golf swing, the preferred space is violated immediately activating any of the user-selectable teaching mechanisms, such as the audible alarm, illumination of the number one status light, and the tee manipulation mechanism, as previously set by the user, thereby lowering tee 20 and removing the golf ball from the intended path of the swinging clubhead. FIG. 4 illustrates a top view of a tee manipulation device. FIGS. 5A and 5B show side views of a tee manipulation device. At the discretion of the user, the tee manipulation mechanism and the status light board 19 can separately be turned on or off before the golf swing. Additional adjustment is allowed as each IR beam can be moved such that the preferred space is made more restrictive thereby requiring the golfer to position the golf club within a smaller preferred space and closer to a preferred golf club swing path.

FIG. 1 also indicates the position of IR transmitter 4, IR receiver 5, and the corresponding IR beam 6. IR transmitter 4 is placed above and behind the golfer on the golfer's left side for a right-handed golfer and on the golfer's right side for a left-handed golfer. IR receiver 5 is placed directly below IR transmitter 4. The corresponding IR beam 6 is used to detect the golf club shaft at the top of the golf swing if the golfer over rotates at the top of the golf swing causing the golf clubhead to point in front of instead of parallel to an imaginary line representing the intended path of the golf ball. IR transmitter 7 is placed above and behind the golfer on the downswing side of the golf swing. IR receiver 8 is placed below and slightly in front of IR transmitter 7. The corresponding IR beam 9 detects a golfer's tendency to prematurely extend the golf club (commonly referred to as "casting"). IR transmitter 10 is positioned near and at the same height as IR transmitter 1. IR receiver 11 is positioned next to IR receiver 2. The corresponding IR beam 12 together with IR beam 3 form a three-dimensional converging channel of preferred space in which the golfer should position the golf club shaft during the takeaway and the downswing phases of the golf swing. IR transmitter 13 is positioned behind the golfer at shoulder height pointed forward and downward. IR receiver 14 is positioned at ground level in front of the golfer and pointed at IR transmitter 13. The corresponding IR beam 15 is in close proximity to the golfer's shoulder detecting any tendency to lean in the direction of intended ball flight. IR transmitter 16 is positioned behind the golfer at hip height pointed forward and downward. IR receiver 17 is positioned at ground level in front of the golfer and pointed at IR transmitter 16. Positioned within the preferred space, the golfer interrupts the corresponding IR beam 18. If, during the execution of the golf swing, the golfer's hip moves opposite the direction of intended ball flight enabling IR receiver 17 to detect IR beam 18 produced by IR transmitter 16, the preferred space is violated thereby activating any of the armed teaching methods.

In FIGS. 1, 2, and 3 the golfer is depicted standing on a platform which houses a tee manipulation device. Without limitations to the preferred embodiments, the invention is intended to cover all alternatives for tee manipulation resulting in ball removal from the intended path of the golf clubhead. FIG. 4 illustrates a top view of a tee manipulation device. FIG. 5A shows a side view of a tee manipulation device in the up position. FIG. 5B shows a side view of a tee manipulation device in the down position. The tee manipulation device is comprised of tee 20, cam 21, electric servo motor 22, tee manipulation lever 23, tee manipulation lever release 24, microswitch 25, and microswitch activation lever 26. If, during the golf swing, the golf club or the golfer's body violates the preferred space defined and monitored by the IR beams, the electric servo motor 22 is activated which rotates cam 21, microswitch activation lever 26, and tee manipulation lever release 24 causing the tee manipulation lever 23 to pivot downward thereby allowing gravity to lower tee 20 along with the golf ball. After 360° of rotation, microswitch activation lever 26 contacts microswitch 25 deactivating servo motor 22. After completion of the golf swing, the golf teaching system can be reset by the user by pressing the appropriate controller switch on controller panel 27. Resetting the tee manipulation device activates servo motor 22 which rotates cam 21, microswitch activation lever 26, and tee manipulation lever release 24 causing the tee manipulation lever 23 to pivot upward thereby raising tee 20 to the proper position for practicing the golf swing. After 360° of rotation, microswitch activation lever 26 contacts microswitch 25 deactivating servo motor 22. A good golf swing is demonstrated by swinging the golf club through the golf swing without violating the preferred space. Violation of the preferred space activates any of the armed teaching mechanisms thereby accelerating the learning process in the presence of or in the absence of an instructor. It is the critical combination of positive reinforcement and negative reinforcement that accelerates the learning process of the multiple biomechanical aspects pertinent to the intricate combination of balanced neuromuscular events comprising a good golf swing. Positive reinforcement is provided by allowing the golfer to strike the golf ball when a good golf swing is executed. Negative reinforcement is provided by the audible alarm, status lights, and the removal of the golf ball. Since an important object of the game of golf is to strike the ball, removal of the golf ball and elimination of the possibility of striking the ball becomes a powerful reason for additional effort by the golfer to stay within the preferred space thereby executing a good golf swing and receiving immediate positive reinforcement as the golfer is allowed to strike the golf ball.

Any combination of IR beams, audible alarm, status lights, and tee manipulation may be set by the user to be active or inactive during the golf swing. If the user desires to practice only one portion of the golf swing, then the user needs to arm only the applicable IR beam or IR beams and corresponding status light or status lights. It is also the user's option to arm or not arm any combination of audible alarm and tee manipulation device.

What is claimed is:

1. A golf training device comprising:

a plurality of infrared transmitters wherein each transmitter transmits an infrared beam along a predetermined line and monitors a golf club or body position of a golfer;

a plurality of infrared sensors wherein each sensor receives an infrared beam from one of the infrared transmitters;

a plurality of status lights operatively connected to said sensors for indicating when the golfer's body or golf club interrupts one of the infrared beams and moves out of a preferred space during execution of a golf club swing, and wherein each status light corresponds to a separate infrared beam; and a tee manipulation device for removing a golf ball from an intended path of golf club swing when the golfer's body or golf club interrupts one of the infrared beams.

2. The golf training device as in claim 1, further comprising an audible alarm for indicating when the golfer's body or golf club interrupts one of the infrared beams and moves out of the preferred space during execution of a golf club swing.

3. The golf training device as in claim 2, wherein a control panel enables on and off control of the audible alarm.

4. The golf training device as in claim 1, wherein each infrared beam can be adjusted so that the preferred space is made more or less restrictive.

5. The golf training device as in claim 1, further comprising a video camera for recording the position of the golfer's body and golf club during execution of the golf club swing.

6. The golf training device as in claim 1, wherein the plurality of infrared transmitters comprises a first transmitter which transmits a first infrared beam along a predetermined line toward a golf tee area, and wherein the first infrared beam monitors the position of the golf club during a takeaway phase of the golf club swing.

7. The golf training device as in claim 6, wherein the plurality of infrared transmitters comprises a second transmitter which transmits a second infrared beam along a predetermined line behind the golfer, and wherein the second infrared beam monitors the position of the golf club at a top phase of the golf club swing.

8. The golf training device as in claim 7, wherein the plurality of infrared transmitters comprises a third transmitter which transmits a third infrared beam along a predetermined line beside the golfer, and wherein the third infrared beam monitors the position of the golf club during a downswing phase of the golf club swing.

9. The golf training device as in claim 8, wherein the third infrared beam monitors the position of the golf club during a middle portion of the downswing phase of the golf club swing.

10. The golf training device as in claim 8, wherein the plurality of infrared transmitters comprises a fourth transmitter which transmits a fourth infrared beam along a predetermined line toward the golf tee area, and wherein the fourth infrared beam monitors the position of the golf club during the downswing phase of the golf club swing.

11. The golf training device as in claim 10, wherein the fourth infrared beam monitors the golf club during a final portion of the downswing phase of the golf club swing.

12. The golf training device as in claim 10, wherein the first infrared beam and the fourth infrared beam form a three-dimensional channel of preferred space in which the golfer should position the golf club shaft during the takeaway and downswing phases of the golf club swing.

13. The golf training device as in claim 10, wherein the plurality of infrared transmitters comprises a fifth transmitter which transmits a fifth infrared beam along a predetermined line starting at approximately the golfer's shoulder and aimed forward and downward, and wherein the fifth infrared beam monitors the position of the golfer's body regarding any tendency to lean in a direction of intended ball flight during execution of the golf club swing.

14. The golf training device as in claim 13, wherein the plurality of infrared transmitters comprises a sixth transmitter which transmits a sixth infrared beam along a predetermined line starting at approximately the golfer's hip and aimed forward and downward, and wherein the sixth infrared beam monitors the position of the golfer's body regarding any tendency for the golfer's hips to move in an opposite direction of the intended golf ball flight during execution of the golf club swing.

15. The golf training device as in claim 1, further comprising a control panel for enabling on and off control of the tee manipulation device, each status light, and each infrared transmitter.

16. The golf training device as in claim 1, wherein the tee manipulation device removes the golf ball from the intended path of golf club swing by lowering a tee and golf ball resting on the tee.

17. The golf training device as in claim 16, wherein the tee manipulation device comprises:

a cam;

an electric motor;

a lever; and a lever release, wherein interruption of one of the infrared beams by the golfer's body or golf club activates the electric motor which rotates the cam and lever release causing the lever to pivot downward and lower the tee and golf ball.

* * * * *